United States Patent [19]

Nishiwaki et al.

[11] Patent Number: 5,045,772

[45] Date of Patent: Sep. 3, 1991

[54] REFERENCE VOLTAGE GENERATOR

[75] Inventors: Kunio Nishiwaki, San Jose; Kevin A. Norman, Belmont, both of Calif.

[73] Assignee: Altera Corporation, San Jose, Calif.

[21] Appl. No.: 591,363

[22] Filed: Oct. 1, 1990

[51] Int. Cl.[5] ..... G05F 3/24

[52] U.S. Cl. ..... 323/313; 323/314; 307/296.1; 307/296.8; 365/189.09

[58] Field of Search ..... 323/313, 314; 307/296.1, 296.5, 296.6, 296.7, 296.8; 365/189.09, 189.11

[56] References Cited

U.S. PATENT DOCUMENTS

| | | | |
|---|---|---|---|
| 4,375,596 | 3/1983 | Hoshi | 323/313 X |
| 4,713,600 | 12/1987 | Tsugaru et al. | 323/314 X |
| 4,873,458 | 10/1989 | Yoshida | 307/296.1 |

*Primary Examiner*—Steven L. Stephan
*Assistant Examiner*—Emanuel Todd Voeltz
*Attorney, Agent, or Firm*—Robert R. Jackson

[57] ABSTRACT

A circuit and method for generating a reference voltage which decreases as a supply voltage increases, and increases as the supply voltage decreases are provided. The circuit includes a voltage divider connected to the input of an inverting amplifier whose output is connected to a level shifter/buffer. Increases in the supply voltage cause the output voltage of the voltage divider and hence the input voltage of the inverting amplifier to increase. Over the operating range, the combined effect of the increasing input and supply voltage cause the output voltage of the inverting amplifier to decrease. Similarly, over the operating range, a decrease in supply voltage causes an increase in output voltage from the inverting amplifier. This output voltage is shifted to a level more convenient for the user by the level shifter/buffer. The buffer also increases the amount of output current that can be supplied by the reference voltage generator.

9 Claims, 3 Drawing Sheets

REFERENCE VOLTAGE GENERATOR

BACKGROUND OF THE INVENTION

This invention relates to circuits for generating reference voltages. More particularly, the invention relates to a reference voltage generator (RVG) circuit whose output voltage varies inversely with its supply voltage. For the purposes of this invention, two voltages Va and Vb will be said to vary inversely if they can be related by the equation $Vb=C-M\ Va$ where C is a constant and M is a positive constant.

Many electronic circuits make use of reference voltage generators in order to maintain a desired operating state. In most cases, the RVG's output voltage is required to remain essentially constant, independent of its supply voltage, but other RVGs having different relationships between the supply voltage and the output voltage are also possible.

RVGs whose output voltages vary inversely with supply voltage have some very useful applications. For example, the performance of many circuits depends critically on the supply voltage. Increasing the supply voltage has the undesirable effect of increasing the power consumed by the circuit, but coupled with this increased power dissipation is the desirable effect of increasing the speed of the circuit. Thus, in some voltage-controlled devices, it is desirable to increase or decrease the voltage supplying the device as the main supply voltage decreases or increases respectively. In this way, the variation of power dissipation in the device due to supply voltage fluctuations is minimized, and an optimum operating power level is maintained.

In view of the foregoing, it is an object of this invention to provide an RVG circuit whose output voltage decreases as the supply voltage increases, and whose output voltage increases as the supply voltage decreases.

SUMMARY OF THE INVENTION

This and other objects of the invention are accomplished by a circuit which includes a voltage divider, an inverting amplifier, and an optional level shifter. The voltage divider produces an intermediate voltage which is a predetermined fraction of the supply voltage. This intermediate voltage is fed to an inverting amplifier whose properties are such that its output voltage varies inversely with its input voltage over a certain range of supply voltages. The output of the inverting amplifier is fed to a level shifter which shifts the output voltage to a level which is more convenient for the end user and increases the output current available from the RVG.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
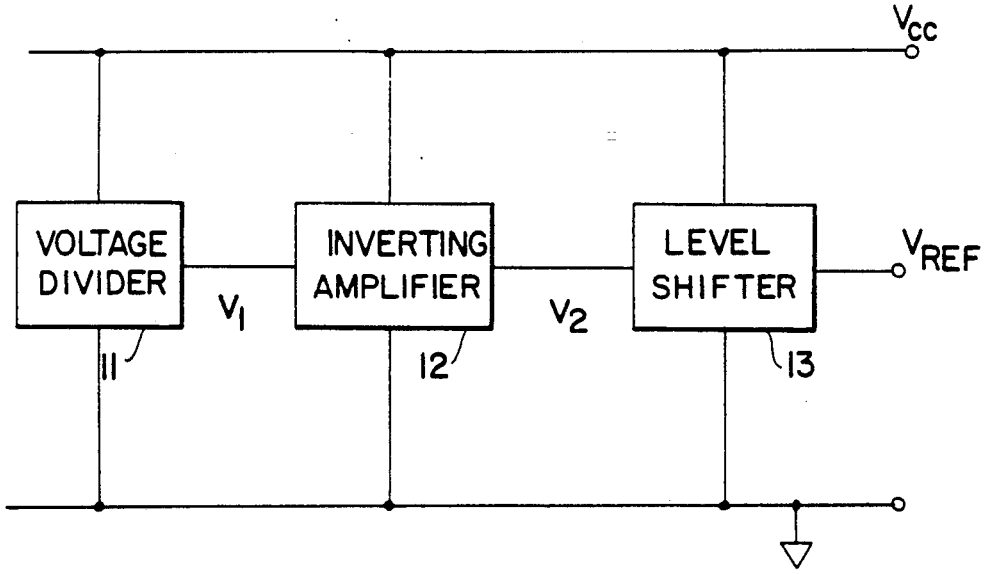
FIG. 1 is a schematic block diagram of a preferred embodiment of the invention.

The block schematic diagram, FIG. 1, shows how the three parts of the circuit are interconnected to form the RVG. Voltage divider 11 produces an intermediate voltage $V_1$ which is a fixed fraction of the supply voltage $V_{cc}$. This intermediate voltage is passed on to inverting amplifier 12 whose characteristics are such that a simultaneous decrease of its input voltage $V_1$ and its supply voltage $V_{cc}$ will result in an increase in its output voltage $V_2$ over a certain supply voltage range. Similarly, a simultaneous increase in $V_1$ and $V_{cc}$ will result in a decrease in $V_2$ over a certain supply voltage range. The supply voltage range over which an inverse relationship exists between $V_2$ and $V_{cc}$ will be termed the "operating range." The voltage $V_2$ is passed on to the input of level shifter 13 which acts as an output buffer and voltage level shifter. The reference voltage $V_{REF}$ is obtained at the output of the level shifter.

Figure 2:
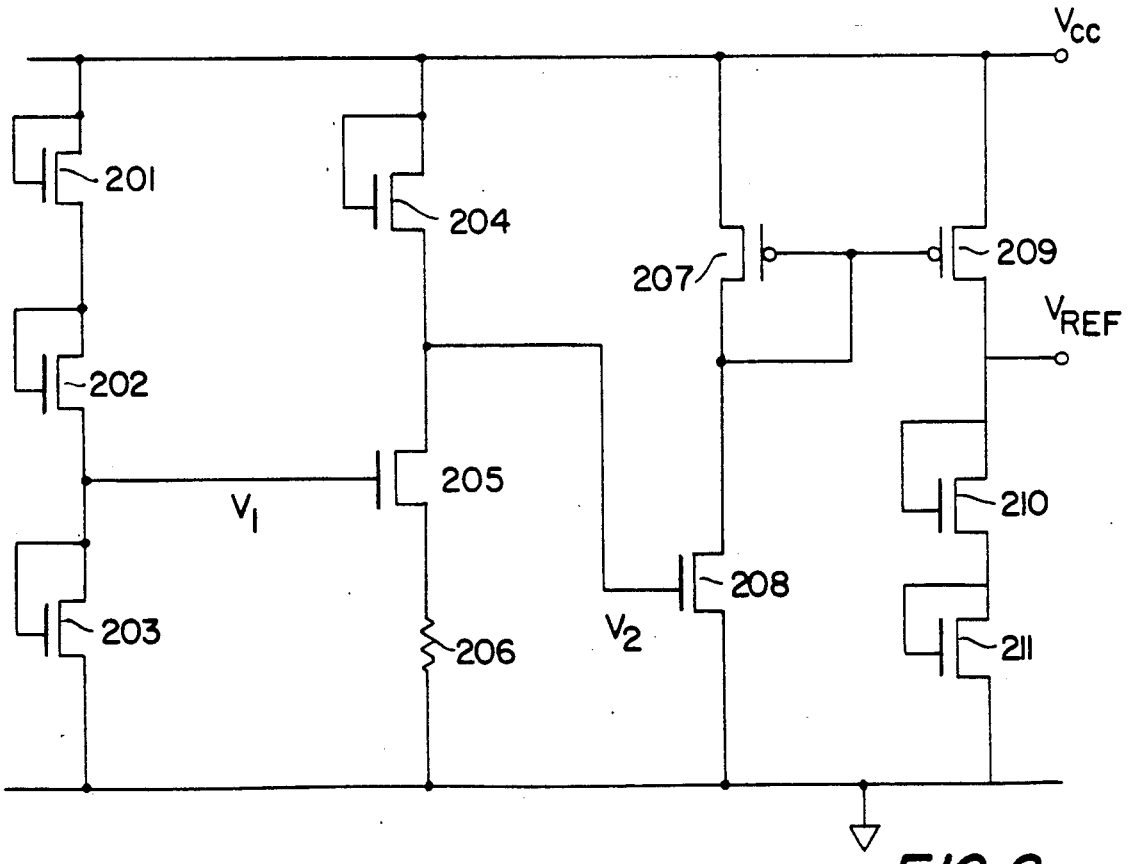
FIG. 2 is a schematic drawing of a Complementary Metal-Oxide-Semiconductor (CMOS) embodiment of the invention.

FIG. 2 shows a schematic diagram of a CMOS embodiment of the RVG. The n-channel transistors 201, 202, and 203 form the voltage divider 11. If transistors 201 through 203 are identical, the intermediate voltage $V_1$ is approximately one third of the supply voltage $V_{cc}$. Other values of $V_1$ can be obtained by changing the number or the geometry of transistors in the voltage divider. In an alternative embodiment, the voltage divider could be implemented as a number of resistors in series. However, in Metal-Oxide-Semiconductor technology, the preferred embodiment of the voltage divider is in the form of a series connection of transistors.

Figure 3:
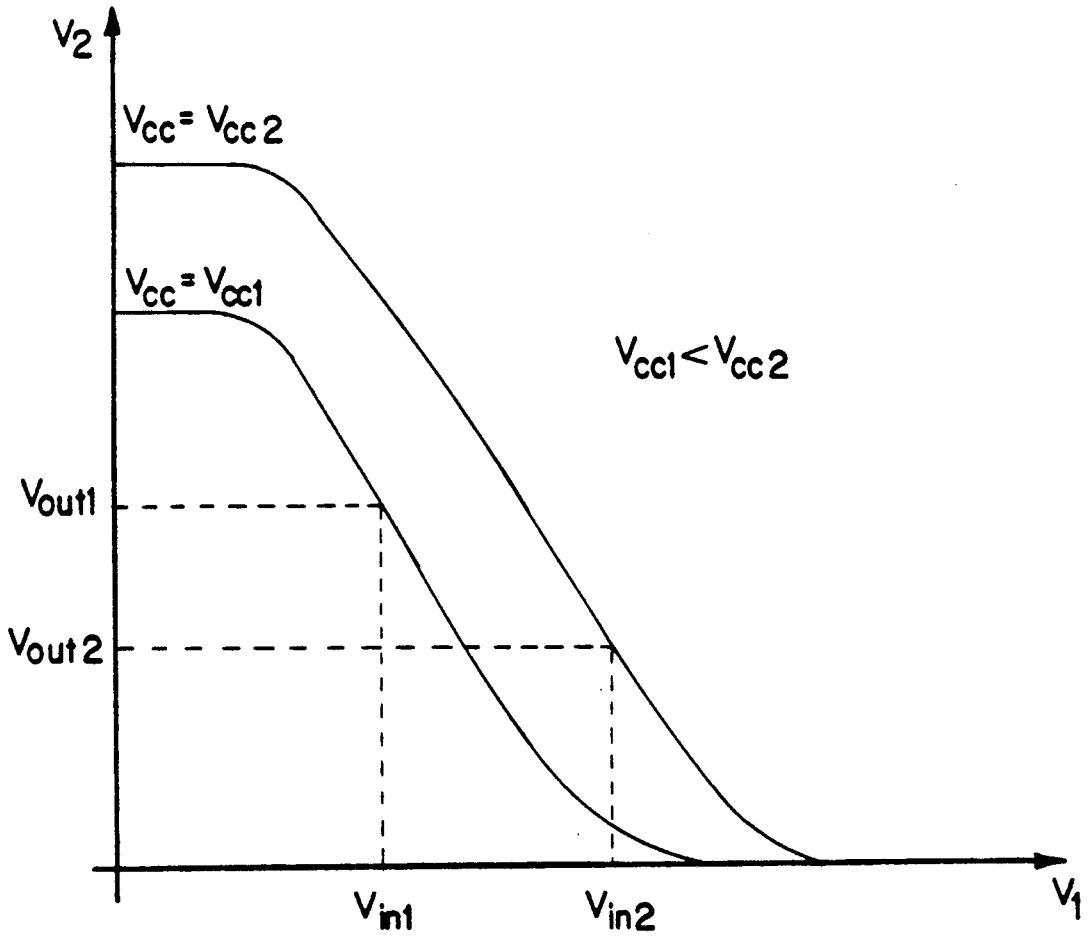
FIG. 3 is a graph showing the transfer characteristics of an inverter for two different supply voltages.

Voltage $V_1$ is fed to the input of the inverting amplifier formed by load transistor 204, drive transistor 205, and resistor 206. Resistor 206 provides negative feedback to stabilize the gain of the inverting amplifier. Typical input/output characteristics of the inverting amplifier shown in FIG. 3. The two curves represent the inverters output voltage $V_2$ as a function of its input voltage $V_1$ for two different values of supply voltage $V_{cc}$. Observe that input voltages $V_{in1}$ and $V_{in2}$, with $V_{in1}$ less than $V_{in2}$, produce output voltages $V_{out1}$ and $V_{out2}$ with $V_{out1}$ greater than $V_{out2}$. Unlike the operation of a conventional inverting amplifier, this inversion of voltage variation is not simply a consequence of a shift in one direction of the input voltage leading to a shift in the opposite direction of the output voltage; it is a combined effect due to the simultaneous change in input and supply voltages. Implicit in the argument is the fact that the change in $V_1$ from $V_{in1}$ to $V_{in2}$ is a result of the change in $V_{cc}$ from $V_{cc1}$ to $V_{cc2}$. Thus, the voltage $V_2$ depends only on $V_{cc}$. If the supply voltage $V_{cc}$ falls below a certain critical level, or rises above another critical level, the desired inverse relationship between voltages $V_1$, $V_2$, and $V_{cc}$ will not be retained. The limits between which this inverse relationship exists define the operating range.

Having produced voltage $V_2$ which varies inversely with $V_{cc}$, a desirable enhancement of the circuit is the addition of a level shifting stage 13. This stage translates the voltage $V_2$ to a more convenient value $V_{REF}$ and, in addition, increases the amount of output current that the RVG can supply. Transistors 207 through 211 form such a level shifter. The level shifting stage 13 comprises a buffer amplifier made up of transistors 207 and 208, a current mirror made up of transistors 207 and 209, and load transistors 210 and 211. The p-channel transistor 209 is chosen to be larger than transistor 207 so that current amplification is obtained. Two load transistors, 210 and 211, are shown in FIG. 2, but more or less than this number can be used. The lowest output voltage obtainable from the circuit is limited to the number of load transistors multiplied by their threshold voltage. If the optional level shifter is not used, $V_2$ is taken to be the reference voltage.

Figure 4:
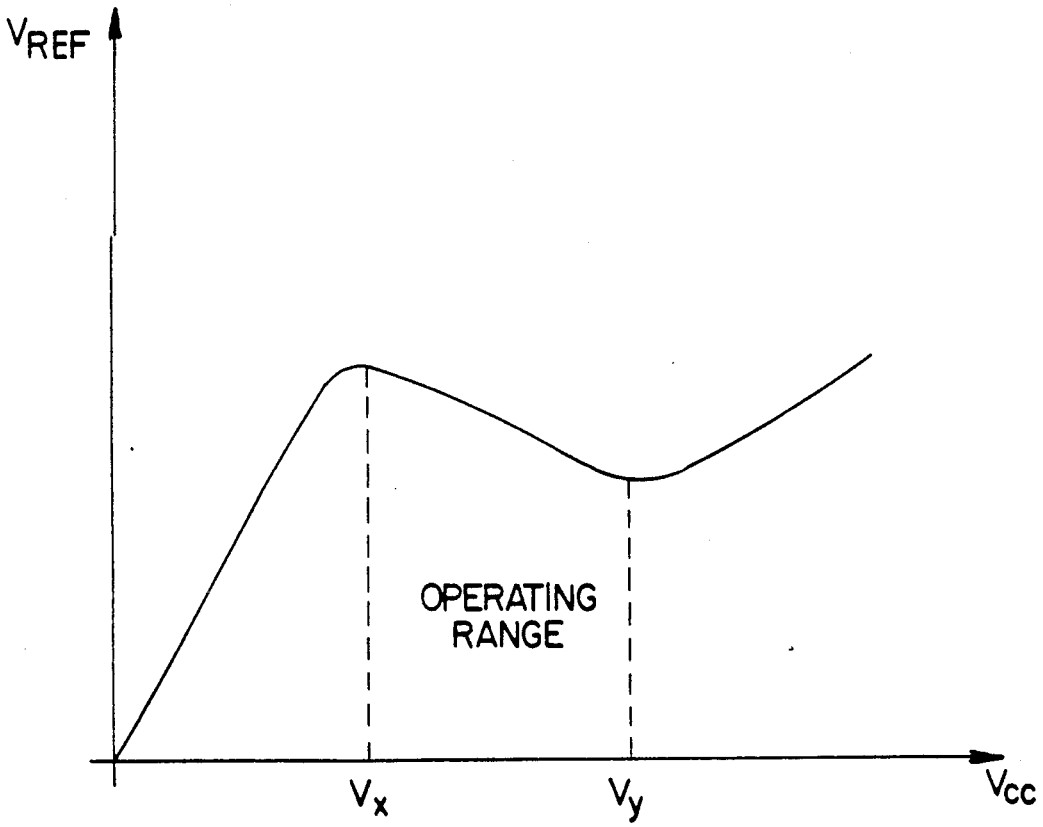
FIG. 4 is a graph showing the output voltage of the RVG as a function of the supply voltage.

The overall operation of the circuit is summarized in FIG. 4 which shows how the reference voltage $V_{REF}$ varies with supply voltage $V_{cc}$. The FIG. shows that the operating range is in the supply voltage range between $V_x$ and $V_y$.

Thus, in the operating range, the desired inverse relationship between output voltage $V_{REF}$ and supply voltage $V_{cc}$ is obtained. One skilled in the art will appreciate that the present invention can be practiced by other than the described embodiments which are presented for purposes of illustration and not of limitation.

What is claimed is:

1. A circuit for generating a reference voltage which varies inversely with a supply voltage, comprising:

means for generating an intermediate voltage which varies substantially in proportion to said supply voltage; and means for translating simultaneous increases in said intermediate voltage and said supply voltage into a decrease in said reference voltage, and for translating simultaneous decreases in said intermediate voltage and said supply voltage into an increase in said reference voltage.

2. The circuit of claim 1 wherein said means for generating an intermediate voltage which varies substantially in proportion to said supply voltage comprises a voltage dividing circuit.

3. The circuit of claim 2 wherein said voltage dividing circuit comprises a plurality of transistors connected in a series arrangement.

4. The circuit of claim 1 wherein said means for translating simultaneous increases in said intermediate voltage and said supply voltage into a decrease in said reference voltage, and for translating simultaneous decreases in said intermediate voltage and said supply voltage into an increase in said reference voltage comprises an inverting amplifier.

5. The circuit of claim 1 further comprising means for increasing the available output current of said circuit for generating a reference voltage.

6. The circuit of claim 1 further comprising means for shifting said reference voltage level.

7. The circuit of claim 6 further comprising means for increasing the available output current of said circuit for generating a reference voltage.

8. A circuit for generating a reference voltage which varies inversely with a supply voltage, comprising:

a voltage dividing circuit which provides an intermediate voltage which varies substantially in proportion to said supply voltage;

an inverting amplifier for translating simultaneous increases in said intermediate voltage and said supply voltage into a decrease in said reference voltage, and for translating simultaneous decreases in said intermediate voltage and said supply voltage into an increase in said reference voltage; and a level shifting circuit for shifting said output voltage and increasing the available output current from said circuit for generating a reference voltage.

9. A method for generating a reference voltage which varies inversely with a supply voltage, comprising the steps of:

generating an intermediate voltage which varies substantially in proportion to said supply voltage;

translating simultaneous increases in said intermediate voltage and said supply voltage into a decrease in said reference voltage, and translating simultaneous decreases in said intermediate voltage and said supply voltage into an increase in said reference voltage.

* * * * *